United States Patent [19]

Leen

[11] 4,378,229

[45] Mar. 29, 1983

[54] METHOD FOR TREATING SEWAGE TO PRODUCE A FUEL

[75] Inventor: Charles Leen, Grand Rapids, Mich.

[73] Assignee: E.R.I., Grand Rapids, Mich.

[21] Appl. No.: 209,738

[22] Filed: Nov. 24, 1980

Related U.S. Application Data

[63] Continuation-in-part of Ser. No. 52,510, Jun. 27, 1979, abandoned.

[51] Int. Cl.[3] ..... C10L 1/00

[52] U.S. Cl. ..... 44/50; 210/532.1; 210/537; 210/800; 210/923; 210/768; 110/219; 110/346; 110/221; 110/238; 44/1 D

[58] Field of Search ..... 44/1 D, 50; 110/219, 110/221, 346, 238; 210/71, 67, 177, 251, 800, 923, 532.1, 537, 768

[56] References Cited

U.S. PATENT DOCUMENTS 3,991,689 11/1976 Rinecker ..... 110/238

*Primary Examiner*—Jacqueline V. Howard

*Attorney, Agent, or Firm*—Waters, Lesniak & Willey

[57] ABSTRACT

A method is disclosed for treating sewage in which the combustible components of the sewage are separated from the sewage and utilized as a primary fuel. Scum is collected, preferably by skimming, from screened sewage. This scum comprises oils, greases, fats, water and intermixed solid material. The collected scum is then transferred to a separation tank. The scum is maintained within the tank in a quiescent and substantially nonagitated state for at least twelve hours, during which the combustible oils, greases, fats and the like are rendered separable from the other components of the scum. The scum is then conveyed from the tank to a processing unit where the fats, oils, greases and the like are separated from the water and solid material remaining in the scum. The resulting product is a combustible product and can be used as a primary fuel.

14 Claims, No Drawings

METHOD FOR TREATING SEWAGE TO PRODUCE A FUEL

CROSS-REFERENCE TO RELATED APPLICATION

This application is a continuation-in-part of co-pending application Ser. No. 052,510, filed June 27, 1979 in the name of James Carney, et al and now abandoned.

BACKGROUND OF THE INVENTION

I. Field of the Invention

The present invention relates to a method for treating sewage and, more particularly, to a method for separating the combustible components of the sewage from the sewage scum.

II. Description of the Prior Art

As used herein, the term "sewage" refers not only to raw sewage but also to byproducts obtained during treatment of the sewage. Similarly, the term "scum" as used herein means the portion of the sewage which floats on top of the raw sewage and is conventionally skimmed from the top of the sewage.

Sewage scum is primarily composed of fats, oils, greases and the like, hereinafter sometimes collectively referred to as oils, intermixed with both water and assorted solid debris. Due to the water and assorted solid debris in the sewage scum, the sewage scum has a low combustibility and previously has been disposed of by grinding, landfill disposal, incineration and other methods. Such disposal of the scum, however, is not only expensive but is also a waste of a valuable energy source.

SUMMARY OF THE PRESENT INVENTION

The present invention provides a method for treating sewage scum to produce a valuable primary fuel.

The method according to the present invention comprises the initial step of screening large solid materials from the influent sewage. This screening step is typically accomplished by passing the influent sewage through bar racks or screens which remove solid particles greater than about four-six inches from the sewage scum.

The screened sewage is then collected in a sedimentation tank where the scum is skimmed off. The skimmed scum is then transferred to a separatory tank where it is allowed to stand in a quiescent and substantially nonagitated state for a period of time of at least twelve hours. After this time, the scum is rendered separable.

During the quiescent period within the separatory tank, a phase separation of the oils from the water occurs by biochemical and biophysical reactions of the scum. This phase separation of the oils from the water can be accelerated by chemical accelerators, heat, periodic aeration, and the like.

Following the quiescent period, the scum is conveyed to a processing unit where the oils are separated from the water and solid particles in the scum. This can be accomplished in a plurality of different fashions, for example, by centrifuging, filtering, distilling, vibrating and/or the like. Elevated temperatures, preferably above 100° F., are employed to effect a more complete and efficient separation.

At the end of the processing stage, the scum has been separated into three distinct components, i.e., the water, the solid debris with some absorbed water, and the oils. The upgraded water is disposed of by returning it to the sewage treatment plant, while the debris or solid material is incinerated or disposed of in a landfill. The resulting oil, which has a viscosity and heat value substantially the same as number six fuel oil, can then be stored for use as a primary fuel.

DETAILED DESCRIPTION OF THE PREFERRED METHOD OF THE PRESENT INVENTION

In sewage treatment plants, the raw sewage undergoes a series of different processes designed not only to kill harmful bacteria within the sewage but also to process the sewage to a state where it can be easily and safely disposed of. One such step during the sewage process is commonly known as "skimming" in which animal fat, oils, greases and other materials which float on the sewage, (hereinafter the "oils") are skimmed from the top of the sewage along with some solid debris and water. The material that is skimmed from the top of the sewage is commonly known as "scum" and is a liquid with a very high viscosity.

According to the method of the present invention, the influent sewage is first screened in order to remove large solid material, e.g., solid material greater than about four to six inches. This screening step can be achieved in any conventional fashion such as by screening bars, screens, or the like.

The screened sewage is then conveyed to a sedimentation tank where the scum is then skimmed and collected. This is accomplished by decreasing the flow rate of the sewage. This decrease in the flow rate of the sewage allows the scum to raise to the top of the sewage, which permits it to be then skimmed from the surface.

The scum, (after collection from the sedimentation tank) is transferred to and maintained in a separatory tank for at least twelve hours in a quiescent and substantially nonagitated state. During this period, the scum undergoes biochemical and biophysical reactions which result in the phase separation of the oils from the water which renders the oils separable from the water. This phase separation can be further enhanced by the addition of certain chemical accelerators, such as aluminum hydroxide or other polyvalent cations, periodic aeration and/or the addition of heat. Following the quiescent period, the scum contains approximately 20% moisture, 20% entrapped solid materials, which are commonly referred to as debris, and approximately 60% oils.

The oils have a lower density than water so that these oils rise to the top of the scum within the separatory tank while the water descends to the bottom of the separatory tank. Preferably, the separatory tank is equipped for drainage of the water from the bottom of the tank and also for decanting of the oil from the top of the tank.

Following the phase separation of the oils from the water in the separatory tank, the decanted scum is conveyed to a processing unit for final dewatering and debris removal by any conventional means, such as by pumping. The processing unit then separates the scum into three basic components, i.e., the water, the debris with some absorbed water and the oils. In the processing unit the scum is maintained at an elevated temperature, e.g., 100° F., to achieve a more complete and efficient separation of the scum components. Examples of suitable processing units are vacuum filters, distillation units, vibrating or rotating screens, and centrifuges.

The water separated from the scum is then disposed of by returning it to the sewage treatment plant or to any sanitary sewer. The debris, which has the characteristic of a high grade coal (approximately 12,000 BTU/lb) can be either incinerated or disposed of in a landfill.

The separated oils form the desired product from the method of the present invention. The product has the physical characteristics of No. 6 fuel oil such as viscosity, sulfur content and air pollutants, with a heat value of approximately 16,500 BTU/lb. This product can then be burned in any conventional burner that is equipped to handle No. 6 fuel oil.

From the foregoing, it can be seen that the present invention provides a unique method for producing a valuable energy source from sewage. The present invention transforms a previously costly and wasteful practice into an efficient and profitable production of a valuable energy source.

Although the preferred embodiment has been described, many modifications thereto will become apparent to those skilled in the art to which it pertains without deviation from the spirit of the invention as defined by the scope of the appended claims.

The embodiments of the invention in which an exclusive property or privilege is claimed are defined as follows:

1. A method for producing fuel from sewage scum comprising the steps of:

transferring sewage scum, which has been skimmed and collected from the surface of screened influent sewage, to a separatory tank;

maintaining said scum in said tank in a quiescent and substantially nonagitated state for at least twelve hours;

thereafter separating the scum from settled water in said tank and conveying said scum to a processing unit;

followed by removing solid material and water from the scum in said processing unit while maintaining the temperature of said scum over 100° F. to yield a fuel product.

2. The method according to claim 1 further comprising periodically aerating the scum in said separatory tank.

3. The method according to claim 1 further comprising adding polyvalent cations to the scum in said separatory tank.

4. The method according to claim 1 further comprising heating the scum in the tank.

5. The method according to claim 1 wherein said processing unit comprises a centrifuge.

6. The method according to claim 1 wherein said processing unit comprises a vacuum filter.

7. The method according to claim 1 wherein said processing unit comprises a distillation tank.

8. The method according to claim 1 wherein said processing unit comprises a vibrating screen.

9. The method according to claim 1 wherein said processing unit comprises a rotating screen.

10. The fuel product produced according to any of claims 1 through 9.

11. A method for producing fuel from sewage scum comprising the steps of:

transferring sewage scum, which has been skimmed and collected from the surface of screened influent sewage, to a separatory tank;

maintaining said scum in said tank in a quiescent and substantially nonagitated state for an extended period of time;

thereafter separating the scum from settled water in said tank and conveying said scum to a processing unit;

followed by removing solid material and water from the scum in said processing unit to yield a fuel product.

12. The method as defined in claim 11 wherein said extended period of time is at least twelve hours.

13. The method as defined in claim 11 and further comprising the step of maintaining said scum at an elevated temperature in said processing unit.

14. The method as defined in claim 13 wherein said elevated temperature is at least 100° F.

* * * * *